US009862075B2

(12) United States Patent
Bowman

(10) Patent No.: US 9,862,075 B2
(45) Date of Patent: Jan. 9, 2018

(54) MULTI-FASTENER WRENCH

(71) Applicant: DEB, LLC, Edwardsville, IL (US)

(72) Inventor: Deidra Bowman, Edwardsville, IL (US)

(73) Assignee: DEB, LLC, Edwardsville, IL (US)

( * ) Notice: Subject to any disclaimer, the term of this patent is extended or adjusted under 35 U.S.C. 154(b) by 403 days.

(21) Appl. No.: 14/744,640

(22) Filed: Jun. 19, 2015

(65) Prior Publication Data

US 2015/0367485 A1 Dec. 24, 2015

Related U.S. Application Data

(60) Provisional application No. 62/014,221, filed on Jun. 19, 2014.

(51) Int. Cl.

| | |
|---|---|
| ***B25B 13/16*** | (2006.01) |
| ***B25B 13/08*** | (2006.01) |
| ***B25B 23/142*** | (2006.01) |
| ***B25B 13/14*** | (2006.01) |

(52) U.S. Cl.

CPC ..... *B25B 13/08* (2013.01); *B25B 13/14* (2013.01)

(58) Field of Classification Search

CPC ..... B25B 13/08; B25B 13/14; B25B 13/48; B25B 13/56; B25B 13/16; B25B 23/142

See application file for complete search history.

(56) References Cited

U.S. PATENT DOCUMENTS

| | | | | |
|---|---|---|---|---|
| 66,643 | A * | 7/1867 | Shepard | B25B 13/48 7/138 |
| 538,639 | A * | 4/1895 | Bourn et al. | B25B 13/48 81/75 |
| 2,421,665 | A * | 6/1947 | Umbdenstock | B25B 13/02 81/119 |
| 2,705,433 | A * | 4/1955 | Goldman | B25B 13/08 81/125.1 |
| 5,544,379 | A * | 8/1996 | Chen | B25B 13/56 280/281.1 |
| RE35,424 | E * | 1/1997 | Seals | B25B 13/56 59/7 |
| 7,698,970 | B1 * | 4/2010 | Chavez | B25B 13/04 7/138 |

* cited by examiner

*Primary Examiner* — David B Thomas
(74) *Attorney, Agent, or Firm* — Lewis Rice LLC

(57) ABSTRACT

A multi-fastener wrench for simultaneously or concurrently holding a plurality of fasteners, wherein the wrench comprises a handle having a distal end and a proximal end, and two sets of jaws at or new the distal end. The jaws may be movably coupled to the handle, allowing the user to vary the distance between the jaws.

9 Claims, 4 Drawing Sheets

MULTI-FASTENER WRENCH

CROSS REFERENCE TO RELATED APPLICATIONS(S)

This Application claims the benefit of U.S. Provisional Patent Application No. 62/014,221 filed Jun. 19, 2014, the entire disclosure of which is herein incorporated by reference.

BACKGROUND

1. Field of the Invention

This disclosure is related to the field of construction equipment, specifically to wrenches for holding bolts and screw heads in place.

2. Description of the Related Art

Many construction projects involve the use of hardware fasteners. Fasteners are devices which mechanically join or affix two objects or components together, including bolts, buckles, buttons, clamps, clasps, ties, pins, flanges, grommets, hooks, bolts, nuts, screws, pegs, dowels, pins, rings, staples, snaps, and zippers. Different fasteners have different fastener strengths, and for certain applications, very strong connections are required, particularly for fasteners used in habitable structures, where a joint failure could result in injury or death.

In many applications, multiple fasteners are used to ensure that the joint is sufficiently strong. For example, deck and railing spindles are both decorative and safety elements, filling gaps between structural elements to prevent pets and people, especially children, from falling through the gaps. As such, ensuring that the spindles are firmly attached to structural elements of the decking is crucial, and multiple strong fasteners may be used.

Single-component fasteners, such as screws, depend upon friction between the fastener and the material into which it is implanted for strength. For screws embedded in wood, this connection can weaken over time, allowing the screw to loosen or dislodge, which can result in the spindle falling loose and presenting a dangerous gap and a falling hazard. Instead, key components like spindles are attached using a bolt and nut combination, where the bolt is inserted through a hole in the spindle mount and a nut is screwed onto the end of the bolt and tightened. The bolt and nut are made from rigid materials, generally a galvanized metal for outdoor applications, and the friction between the bolt and nut attachment provides added strength and does not depend upon the wood maintaining its structural strength. For extra stability, a pair of bolts is used to mount each end of the spindle.

While this lends superior strength to the construction, it adds time. Attaching a screw is a simple matter of using a powered drill to drive the screw into the wood, and takes mere moments. Other single-component fasteners are even simpler, such as brads or nails which can be almost instantaneously driven into the wood using an air-powered tool. This requires the worker to view the installation point only from the attaching side. The worker simply lines up the spindle hole with the wood and drives the fastener.

However, for a bolt and nut installation, hardware is installed on both sides of the attaching surface, requiring the worker to insert the bolt through one side of the structure and screw the nut onto the other, or hold the nut in place on the far side of the structure and screw the bolt through it. Either way, more time and care is required. Instead of simply driving a fastener into one hole and then another, the worker must pause between fasteners to seat the next bolt and nut. While the difference in time may be a matter of a few seconds for a single fastener, a worker may have to attach four or more bolts per spindle, and for a large project, may have to install hundreds or thousands of spindles. Even a difference of a few seconds can add up to hours of lost efficiency and additional worker fatigue for a single project.

Having hardware on both sides of the attaching surface in turn requires two tools because a human hand and/or fingers generally lack the resistive force to allow the fasteners to be sufficiently tightened. Each of the two tools must be configured for the proper size and shape of fastener and bolt: one to hold the nut in place, and one to turn the bolt, or vice versa. Where two structural elements are being fastened together, the elements must also be held in place. This presents a difficult maneuver for the builder, who must hold multiple components in place, hold multiple fasteners in place, and then attach, hold in place, and manipulate two different tools.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Described herein, among other things, is a wrench comprising: a handle having a distal end and an opposing proximal end; a distal jaw set comprising a top distal jaw disposed on a side of the handle at the distal end and extending generally perpendicularly from the handle, and a bottom distal jaw disposed on the side of the handle between the top distal jaw and the proximal end, the bottom distal jaw extending generally perpendicularly from the handle; and a proximal jaw set comprising a top proximal jaw disposed on the side of the handle between the bottom distal jaw and the proximal end, the top proximal jaw extending generally perpendicularly from the handle, and a bottom proximal jaw disposed on the side of the handle between the top proximal jaw and the proximal end, the bottom proximal jaw extending generally perpendicularly from the handle.

In one embodiment of the wrench, the top distal jaw has a generally planar gripping surface disposed thereon, and the bottom distal jaw has a generally planar gripping surface disposed thereon generally parallel to the top distal jaw gripping surface.

In another embodiment of the wrench, the top proximal jaw has a generally planar gripping surface disposed thereon, and the bottom proximal jaw has a generally planar gripping surface disposed thereon generally parallel to the top proximal jaw gripping surface.

In still another embodiment of the wrench, the wrench comprises: a handle having a distal end and an opposing proximal end; a distal fixed jaw disposed generally perpendicularly on a side of the handle at the distal end; a proximal jaw disposed generally perpendicularly on the side between the distal fixed jaw and the proximal end, the proximal jaw having a hole therethrough, the hole being configured generally parallel to the handle; and a moveable carriage movably coupled to the handle and comprising a distal end and an opposing proximal end, the proximal end being generally sized and shaped to slide through the hole; a fixed jaw disposed generally perpendicularly on a side of the moveable carriage, the side of the movable carriage being generally parallel to the side of the handle; a movable jaw movably coupled to the movable carriage on the side of the moveable carriage between the moveable carriage fixed jaw and the proximal end of the movable carriage; wherein the moveable carriage is disposed on the side of the handle between the distal fixed jaw and the proximal end, such that the proximal end of the moveable carriage slides through the hole when the movable carriage is moved towards the proximal end and the moveable jaw disposed on the moveable carriage is disposed between the moveable carriage fixed jaw and the proximal jaw.

In still another embodiment of the wrench, the movable carriage moves generally linearly along the major axis of the handle.

In still another embodiment of the wrench, the movable carriage is moved using a thumbscrew in the handle.

In still another embodiment of the wrench, the proximal jaw is fixedly disposed on the handle.

In still another embodiment of the wrench, the proximal jaw is moveably coupled to the handle.

In still another embodiment of the wrench, the proximal jaw moves generally linearly along the major axis of the handle.

In still another embodiment of the wrench, the proximal jaw is moved using a thumbscrew in the handle.

In still another embodiment of the wrench, the distal fixed jaw has a generally planar gripping surface disposed thereon, and the fixed jaw on the movable carriage has a generally planar gripping surface disposed thereon generally parallel to the distal fixed jaw gripping surface.

In still another embodiment of the wrench, the movable jaw on the movable carriage has a generally planar gripping surface disposed thereon, and the proximal jaw has a generally planar gripping surface disposed thereon generally parallel to the top proximal jaw gripping surface.

In still another embodiment of the wrench, the wrench comprises: a handle having a distal end and an opposing proximal end; a distal jaw disposed on a side of the handle at the distal end and extending generally perpendicularly from the handle; and a proximal jaw disposed on the side of the handle between the distal jaw and the proximal end, the proximal jaw extending generally perpendicularly from the handle; and a center jaw disposed on the side of the handle between the distal jaw and the proximal jaw, the center jaw extending generally perpendicularly from the handle.

In still another embodiment of the wrench, the distal jaw has a generally planar first gripping surface disposed thereon, and the center jaw has a first generally planar gripping surface disposed thereon generally parallel to the distal jaw gripping surface.

In still another embodiment of the wrench, the center jaw has a generally planar second gripping surface disposed thereon generally parallel to the first gripping surface, and the proximal jaw has a generally planar gripping surface disposed thereon generally parallel to the second gripping surface.

DESCRIPTION OF THE PREFERRED EMBODIMENT(S)

The following detailed description and disclosure illustrates by way of example and not by way of limitation. This description will clearly enable one skilled in the art to make and use the disclosed systems and apparatus, and describes several embodiments, adaptations, variations, alternatives and uses of the disclosed systems and apparatus. As various changes could be made in the above constructions without departing from the scope of the disclosures, it is intended that all matter contained in the above description or shown in the accompanying drawings shall be interpreted as illustrative and not in a limiting sense.

Described herein, among other things, is a multi-fastener wrench for simultaneously or concurrently holding a plurality of fasteners. The described wrench is useful with individual and two-component fastener systems to allow fasteners to be quickly driven into the work piece. For example, the wrench may hold two nuts at the proper distance from one another for a particular application such that a pair of bolts can be quickly driven through the work piece to interlock with each nut, or, alternatively, the bolt heads are held and the nuts are quickly screwed on. In an alternative embodiment, the jaws used to hold the fastener in place are independently adjustable such that distance between the jaws may be adjusted to accommodate multiple sizes of fasteners. In a still further embodiment, the distance between jaws may be adjusted to accommodate different span distances between the fasteners to be held. The wrenches described herein are generally described with respect to holding a fastener, but it also specifically contemplated that the wrenches may be used to drive a fastener.

Figure 1:
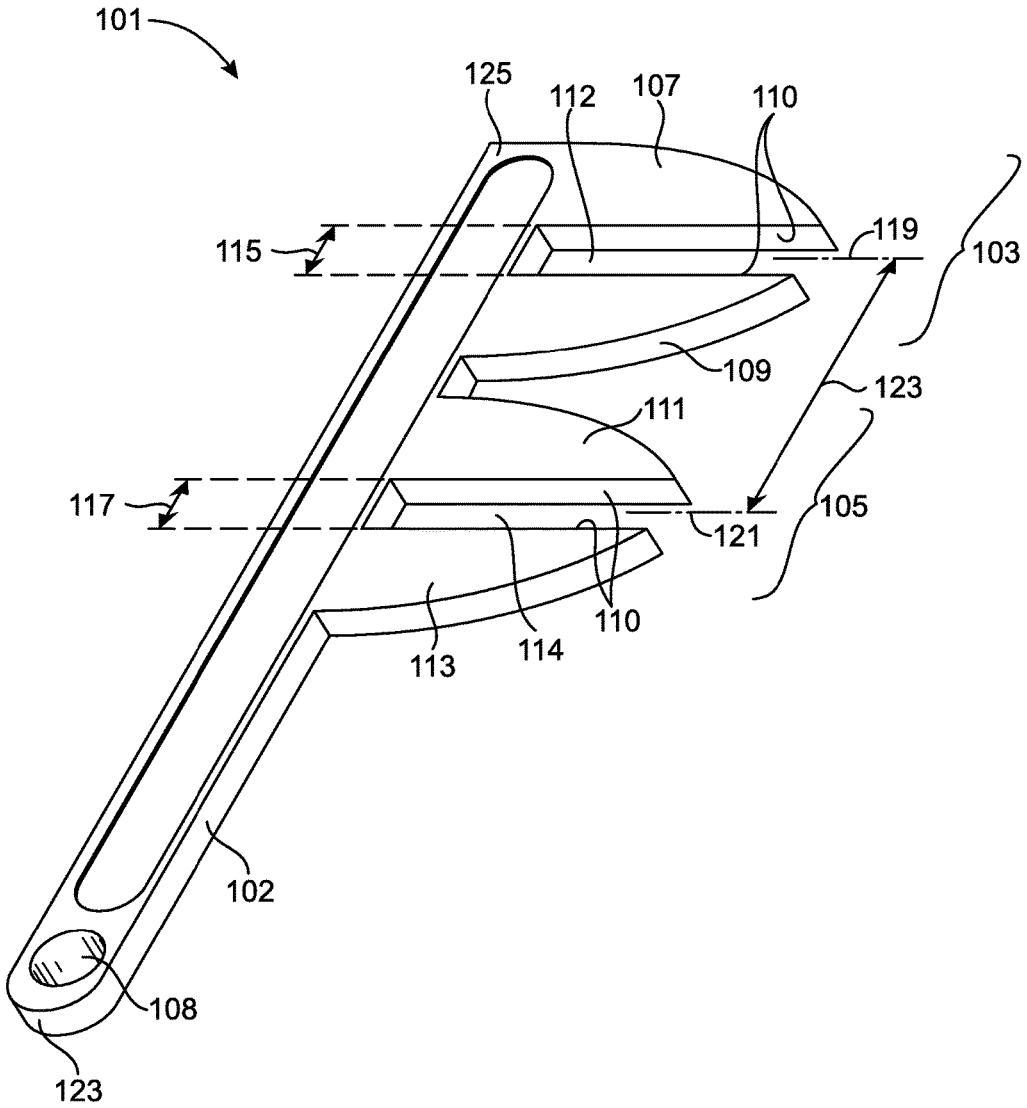
FIG. 1 depicts a diagram of an embodiment of a multi-fastener wrench with two sets of independently adjustable jaws with a fixed span distance.

In the depicted embodiment of FIG. 1, the wrench (101) generally comprises a handle (102) with two sets of jaws (103 and 105) generally perpendicularly disposed on and rigidly attached to the handle (102) at or near the distal (125) end. The handle (102) is, generally speaking, in the configuration of an elongated rectangular prism, but generally sized and shaped for prolonged gripping. This may include, without limitation, rounding edges and deviating from the generally elongated rectangular prism shape to include ergonomic contours matching the shape of a hand when grasping a tool. This is because the wrench (101) will generally hold fasteners (or fastening means) in place to resist rotational force imparted on the fasteners during fastening from an interlocking component being screwed into them. This force is translated to the handle, which is inclined to rotate with the fastener. This rotational force is countered by resistance supplied by the human user holding the wrench in place by the handle. Smoothed edges and contoured shape reduce discomfort and fatigue during use.

In the depicted embodiment, the distal jaw set (103), comprises a top distal jaw (107) and a bottom distal jaw (109), both of which are generally perpendicularly disposed on and rigidly attached to the handle (102) at or near the distal end (125) of the handle (102). The top distal jaw (107) is nearer the distal end (125) and generally flush with the distal end (125) forming a generally smooth surface. The bottom distal jaw (109) is generally perpendicularly disposed on and rigidly attached to the handle (102) at a point nearer to the proximal end (123) than is the top distal jaw (107). The depicted distal jaws (107 and 109) each comprise at least one generally planar gripping face or gripping surface (110) and are generally disposed on the handle (102) such that their respective gripping faces (110) are in opposing and parallel positions, but not co-planar, defining a distal gap (112) of generally consistent width (115) between the respective gripping faces (110). In the depicted embodiment of FIG. 1, the width (115) of the distal gap (112) is pre-determined to accommodate fasteners having a particular dimension and will generally be slightly larger than the width of the fastener with which the wrench (101) is meant to be used. By way of example and not limitation, the width (115) of the distal gap (112) may be about one-quarter of an inch or slightly larger to accommodate quarter-inch nuts, bolt heads, or other fasteners of that dimension.

The depicted wrench (101) also comprises a proximal jaw set (105) comprising proximal jaws (111 and 113). Similar to the distal jaw set (103), proximal jaws (111 and 113) are generally in the shape of elongated rectangular prisms and comprise a generally planar gripping face (110). Jaws (111 and 113) are generally disposed on the handle (102) such that the gripping faces (110) are opposing and parallel but non-co-planar, defining a generally equidistant space (114) between the gripping faces (110). This space (114), also referred to herein as the proximal gap (114), comprises a width (117). The width (117) is generally pre-determined to accommodate fasteners having a particular dimension. By way of example and not limitation, the width of the proximal gap (117) may be about one-eighth of an inch to accommodate one-eighth nuts, bolt heads, or other hardware of that dimension.

The depicted gaps (115 and 117) each have a center line (119 and 121). The span distance (123) between the center lines (119 and 121) is about the same as the distance between the two fasteners to be held by the wrench for a particular application. For example, if the wrench (101) is designed for use with a pair of ⅜ inch nuts 3 inches apart, then jaws (107 and 109) are disposed on the handle (102) such that the gap between the facing surfaces (110) is about ⅜ inch, and jaws (111 and 113) are disposed on the handle (102) such that the gap between the facing surfaces (110) is about ⅜ inch and the span distance (123) between the centerline (119) of the distal gap (112) and the centerline (121) of the proximal gap (114) is about 3 inches. The particular location of the jaws (107, 109, 111, 113) will vary from embodiment to embodiment to accommodate the needs of a particular project.

The centerline is used because fasteners are generally in the configuration of a regular polygonal head with a threaded rod rigidly attached thereto at about the center of the head. The rod is inserted through a hole and the head is turned so that the body threads through a corresponding nut, or held in place and a nut is rotated onto the threaded rod. The head and/or nut are generally in a regular polygonal shape so that a gripping tool, such as a wrench, can be releasably engaged with the head to rotate it without slippage, as slippage can damage the wrench and/or the fastener. The centerlines (119 and 121) represent the approximate location of the rod portion of the fastener, and the span distance (123) between the centerlines (119 and 121) thus defines the distance between the two fasteners to be held for a particular application. Gaps (112 and 114) may be sized and shaped to accommodate the same, or different, sizes of fastening hardware.

The depicted wrench (101) may also comprise an opening or aperture (108) through the handle (102), generally near the proximal end (123) as depicted, or alternatively near the distal end (125). The opening (108) provides for easy disposal of the wrench on a hook, belt, or nail. In an embodiment, the opening (108) is sized and shaped to releasably engage hardware of a particular size or shape, such as a quarter inch hex nut, and may be used to apply rotational force to a fastener in similar fashion to a traditional wrench.

The depicted jaws are generally in the shape of an elongated rectangular prism having at least one generally planar gripping surface (110). This surface is generally smooth so that the gripping surfaces (110) are generally parallel to and nearly coplanar with opposing sides of the head. In an alternative embodiment, one or more gripping faces (110) may be ridged or otherwise textured. The depicted jaws (107, 109, 111, 113) have tapered ends to present a generally round profile when the jaws are closed or nearly closed, allowing the wrench to be more easily rotated or positioned within tight spaces. In an alternative embodiment, not depicted, the tapered ends may be replaced by an alternative shape, which may reduce manufacturing, machining, and/or material costs for production.

In the depicted embodiment of FIG. 1, the jaws are disposed generally perpendicularly on the handle, but they need not be. For example, in an alternative embodiment, not depicted, in the figures, the wrench may be in a general T-shape and the jaws are attached generally perpendicularly to a crossbar of the T and the handle is also attached generally perpendicularly to the crossbar on the opposing side from the jaws. Also in the depicted embodiment of FIG. 1, the sets of jaws are disposed in generally coplanar fashion along the handle, but they need not be. In an alternative embodiment, for example, the two sets of jaws are disposed on opposing sides of the handle.

The wrench is generally made from a rigid material of sufficient strength to retain its own shape and resist the rotational force of hardware fastening. Typically, this material is a steel, metal or metal alloy, and may be galvanized or chrome-plated to resist damage and weathering. The wrench may also be magnetized to assist in holding metallic fasteners and/or other components.

Figure 2:
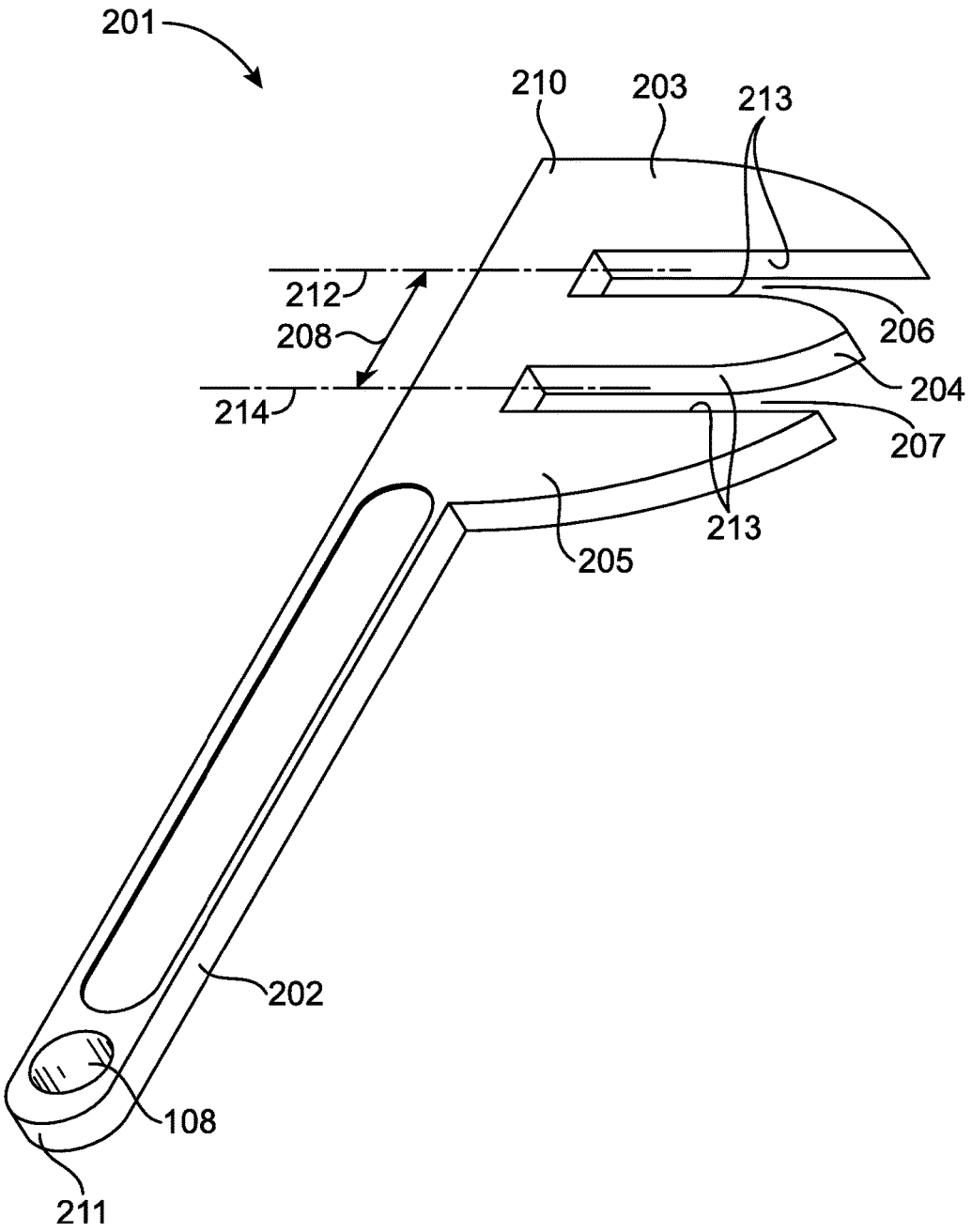
FIG. 2 depicts a diagram of an embodiment of a multi-fastener wrench with fixed jaws.

In an alternative embodiment, depicted in FIG. 2, the wrench (201) comprises three jaws, a distal jaw (203), proximal jaw (205) and center jaw (204). Similar to the depicted embodiment of FIG. 1, the jaws (203, 204, and 205) are generally perpendicularly disposed on and rigidly attached to a handle (202). In the depicted embodiment, the distal jaw (203) is generally attached near the distal end (210) of the handle (201) and the proximal jaw (205) is attached at a point between the distal end (210) and proximal end (211), with the center jaw (204) disposed at a point between the distal jaw (203) and proximal jaw (205).

The jaws (203, 204, and 205) are generally in the shape of elongated rectangular prisms and comprise a generally planar gripping face (213). The jaws (203, 204, and 205) are generally disposed such that the gripping faces (213) are opposing and parallel but non-co-planar, defining equidistant spaces (206 and 207) between the gripping faces (213). These spaces (206 and 207) are also referred to herein as the distal gap (206) and proximal gap (207).

The specific attachment points are determined based on the size of the fasteners for which the wrench (201) is designed to be used, and the span distance between the fasteners. That is, the disposition of the distal jaw (203) and the center jaw (204) is determined such that the width of the distal space (206) is configured to accommodate a particular size fastener. By way of example and not limitation, where the intended fastener size is a quarter-inch, the width of the distal gap (206) is about one quarter-inch. Similarly, the disposition of the proximal jaw (205) relative to the center jaw (204) is determined such that the width of the proximal space (207) is configured to accommodate a particular size fastener.

Gaps (206 and 207) each comprise a center line (212 and 214). The distance (208) between the center lines (212 and 214) is about the same as the distance between the two fasteners to be held by the wrench (201) for a particular application. Unlike the embodiment of FIG. 1, the span distance (208) is not only a function of jaw location on the handle, but of the width of center jaw (204), because center jaw (204) comprises two opposing gripping faces (213). For example, if the wrench (201) is designed for use with a pair of ⅛ inch bolts nuts 2 inches apart, then jaws (203 and 204) are disposed on the handle (102) such that the gap (206) between the facing surfaces (213) is about ⅛ inch, the width of center jaw (204) is such that the span distance (208) is about 2 inches, and proximal jaw (205) is disposed such that the proximal gap (207) is about ⅛ inch.

Figure 3:
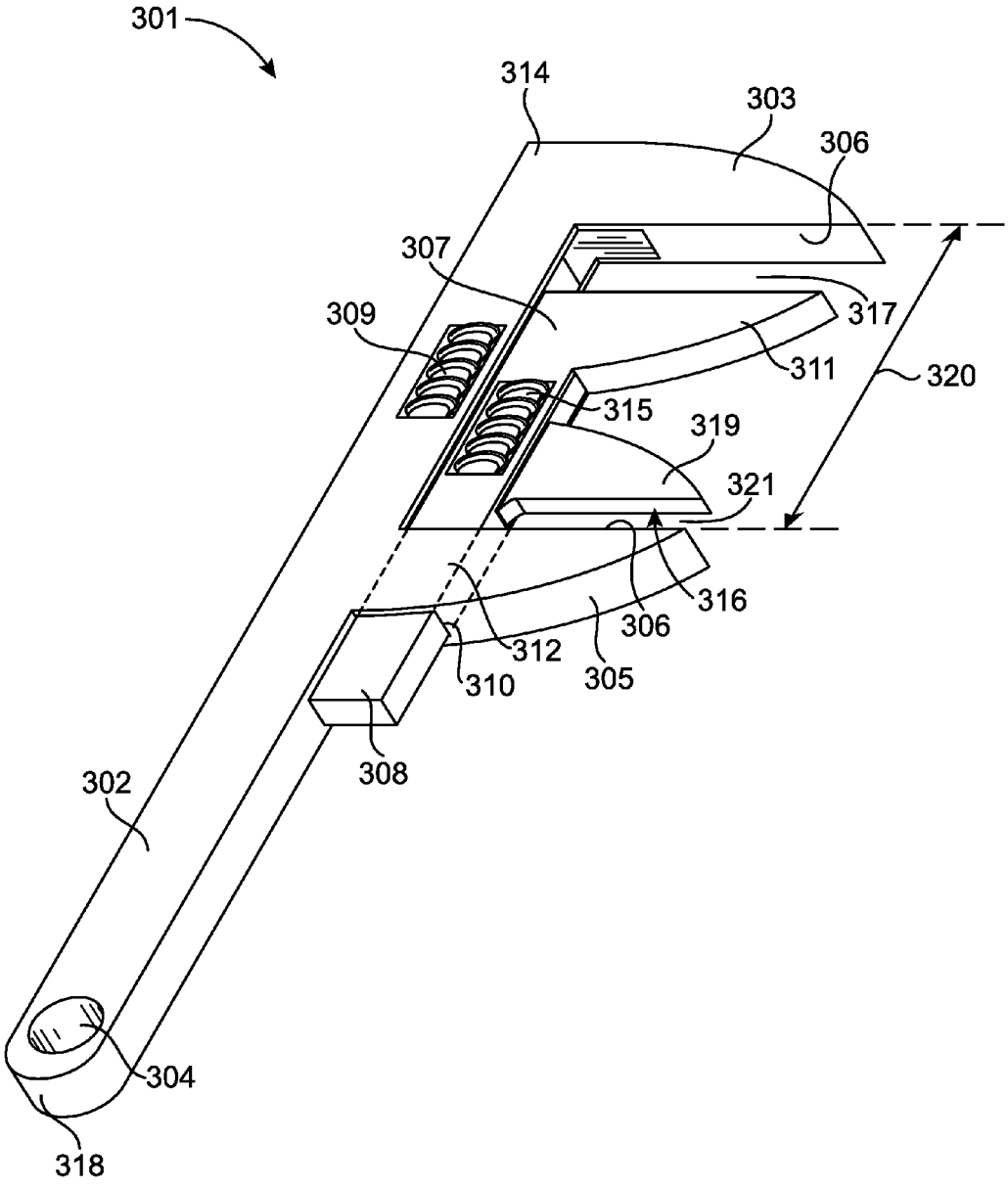
FIG. 3 depicts a diagram of an embodiment of a multi-fastener wrench with two sets of independently adjustable jaws.

In a still further embodiment, the wrench comprises adjustable jaws which allow the wrench to be used with variable-size hardware. One such embodiment is depicted in FIG. 3. The adjustable multi-fastener wrench (301) of FIG. 3 comprises a handle (302) with a distal fixed jaw (303) and a proximal fixed jaw (305), both rigidly and generally perpendicularly attached to the handle (302) and both jaws (303 and 305) comprising at least one generally planar gripping face (306). The distal fixed jaw (303) is attached at the distal end (314) and the proximal fixed jaw (305) is attached at a point on the handle (302) between the distal fixed jaw (303) and the proximal end (318). Jaws (303 and 305) are generally disposed on the handle (302) such that their respective gripping faces are opposing and generally parallel but not coplanar, defining a space between them of generally consistent width (320). The location of the proximal fixed jaw (305) is determined based on the width (320) required for this wrench to be used in a particular application. This is because fixed jaws (303 and 305) cannot be moved and each of the two fasteners with which this wrench is to be used will be held in place by one of jaws (303 and 305).

The depicted wrench (301) further comprises a moveable carriage (307) coupled to the handle (302) and movable relative to fixed jaws (303 and 305) using a handle thumbscrew (309) in the handle (302). The movable carriage (307) comprises a fixed carriage jaw (311) attached rigidly and generally perpendicularly thereto at the proximal end of the carriage and a moveable jaw (319) coupled to the carriage (307) and movable relative to the fixed carriage jaw (311) using a carriage thumbscrew (315) in the carriage (307). Generally speaking, thumbscrews (309 and 315) comprise ridges configured for interlocking with a series of grooves or ridges on the ventral side of the coupled element. That is, the handle thumbscrew (309) interlocks with grooves on the ventral side of the carriage (307), such that when the handle thumbscrew (309) is rotated, the carriage is moved distally or proximally with respect to the handle (302), and the carriage thumbscrew (315) interlocks with grooves on the ventral side of the movable jaw (319), such that when the carriage thumbscrew (315) is rotated, the movable jaw (319) moves distally or proximally with respect to the carriage (307).

The depicted fixed carriage jaw (311) comprises at least one generally planar gripping face (306) and is disposed on the carriage (307) such that the gripping face (306) is generally parallel to the gripping face (306) of the distal fixed jaw (303). The carriage (307) may be moved distally until the gap (317) between the distal fixed jaw (303) and the carriage fixed jaw (311) is configured to hold or drive the desired size of fastener. By way of example and not limitation, for a ⅜ inch bolt, the carriage (307) is moved distally until the gap (317) is about ⅜" or slightly larger to accommodate a ⅜ inch bolt.

The movable carriage jaw (319) comprises at least one generally planar griping face (316) and is coupled to the carriage (307) such that the gripping face (316) is generally parallel to the gripping face (306) of the proximal fixed jaw (305). The movable carriage jaw (319) may be moved proximally until the gap (320) between the movable carriage jaw (319) and proximal fixed jaw (305) is configured to hold or drive the desired size of fastener. By way of example and not limitation, for a ¼ inch bolt, the moveable carriage jaw (319) is moved distally until the gap (320) is about ¼" or slightly larger to accommodate a ¼ inch bolt. Gaps (317 and 321) may be the same or different in a particular use.

In the depicted embodiment, a portion (312) of the carriage (307) may extend through and/or may extend beyond (308) the proximal fixed jaw (305). This may be done, for example, by threading the extending portion (312) through a hollow space (310) in the proximal fixed jaw (305) sized and shaped to accommodate the carriage (307). This is because the carriage (307) should be long enough that when the carriage (307) is near the distal fixed jaw (303), the carriage (307) body extends far enough proximally that the movable carriage jaw (319) can be moved close enough to the proximal fixed jaw (305) to hold or drive the desired hardware. However, without a hollow space (310) for the carriage (307) body to move through, if the carriage (307) is then moved proximally away from the distal fixed jaw (303), the proximal end of the carriage (307) would be blocked from further proximal movement by the gripping face (306) of the proximal fixed jaw (305).

It should be noted that the carriage orientation may vary from the depicted embodiment. By way of example and not limitation, the carriage (307) orientation may be reversed. That is, in an alternative embodiment, the carriage (307) fixed jaw (311) may be on the proximal end of the carriage (307) and disposed such that its gripping face (306) opposes that of the proximal fixed jaw (305), and the movable carriage jaw (319) faces and opposes the distal fixed jaw (303). This configuration may be preferred because in this configuration, if a portion (308) of the carriage (307) extends beyond the fixed jaw, it would extend longitudinally beyond the distal fixed jaw (303) instead of the proximal fixed jaw (305), and would be less likely to interfere with gripping the handle (302) for certain configurations.

Figure 4:
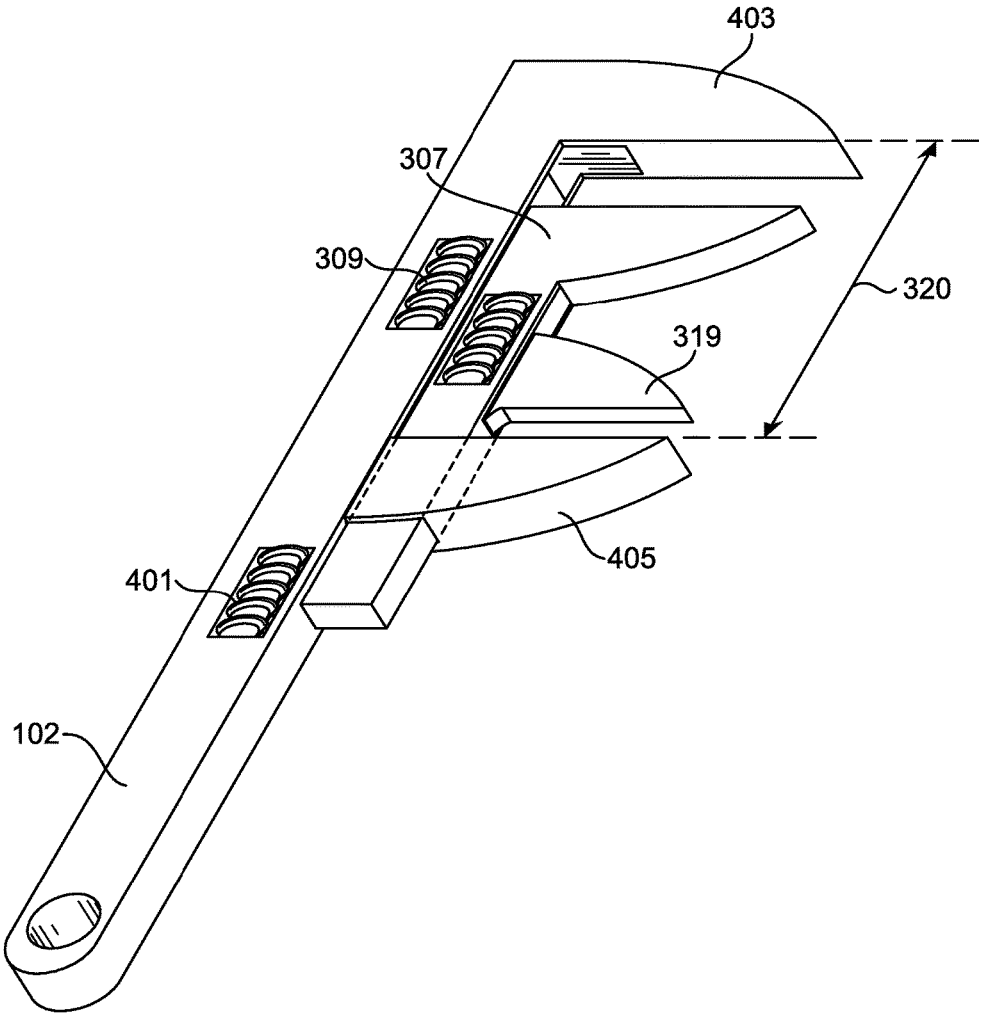
FIG. 4 depicts a diagram of an embodiment of a multi-fastener wrench with two sets of independently adjustable jaws with an adjustable span distance.

In a still further embodiment, one or both of the fixed proximal jaw (305) and/or fixed distal jaw (403) may instead be a movable jaw, such as that depicted in FIG. 4. In the depicted embodiment of FIG. 4, the proximal jaw (405) is movable using a proximal jaw thumbscrew (401) in the handle (102). This configuration permits not only the size of each fastener to vary from use to use, but also the spanning distance between the fasteners. By way of example and not limitation, the proximal movable jaw (405) can be moved proximally along the handle (102) to the desired span distance (320) for a particular application. The movable carriage (307) and movable carriage jaw (313) can then be further adjusted for the size of the particular fasteners as described elsewhere herein, allowing the depicted wrench to be used in a wide number of applications involving variable span distances and fastener sizes.

To prevent the movable carriage (307) and movable proximal jaw (405) from colliding or interfering with each other, the size and shape of the portion of the carriage (307)

and/or movable proximal jaw (405) in the handle (102) may be adjusted or customized to facilitate these elements sliding past one another. By way of example and not limitation, one element may comprise a hollow or aperture through which a portion of the other element may slide. Also by way of example and not limitation, the elements may be in opposing and complementary shapes, such that they may slide past one another laterally, dorsally, or ventrally within the handle. Also by way of example and not limitation, the movable proximal jaw thumbscrew (401) may be placed near the proximal end of the handle (102) and the portion of the proximal movable jaw (405) within the handle may be sized and shaped for interlocking with the proximal jaw thumbscrew (401) while also not interfering with the operation of the movable carriage (307) and/or movable carriage thumbscrew (309), and vice versa.

In an embodiment, one or more jaws may be lockable in place. In repeated uses, the jaws may naturally tend to loosen. By locking the jaws in place, for example, by using a ratchet or other locking mechanism, the tool can be used repeatedly in a particular selected configuration to hold components for multiple installations.

While this invention has been disclosed in connection with certain preferred embodiments, this should not be taken as a limitation to all of the provided details. Modifications and variations of the described embodiments may be made without departing from the spirit and scope of this invention, and other embodiments should be understood to be encompassed in the present disclosure as would be understood by those of ordinary skill in the art.

The invention claimed is:

1. A wrench comprising:

a handle having a distal end and an opposing proximal end;

a distal fixed jaw disposed generally perpendicularly on a side of said handle at said distal end;

a proximal jaw disposed generally perpendicularly on said side between said distal fixed jaw and said proximal end, said proximal jaw having a hole therethrough, said hole being configured generally parallel to said handle; and a moveable carriage movably coupled to said handle and comprising:

a distal end and an opposing proximal end, said proximal end being generally sized and shaped to slide through said hole;

a fixed jaw disposed generally perpendicularly on a side of said moveable carriage, said side of said movable carriage being generally parallel to said side of said handle;

a movable jaw movably coupled to said movable carriage on said side of said moveable carriage between said moveable carriage fixed jaw and said proximal end of said movable carriage;

wherein said moveable carriage is disposed on said side of said handle between said distal fixed jaw and said proximal end, such that said proximal end of said moveable carriage slides through said hole when said movable carriage is moved towards said proximal end and said moveable jaw disposed on said moveable carriage is disposed between said moveable carriage fixed jaw and said proximal jaw.

2. The wrench of claim 1, wherein said movable carriage moves generally linearly along the major axis of said handle.

3. The wrench of claim 2, wherein said movable carriage is moved using a thumbscrew in said handle.

4. The wrench of claim 1, wherein said proximal jaw is fixedly disposed on said handle.

5. The wrench of claim 1, wherein said proximal jaw is moveably coupled to said handle.

6. The wrench of claim 5, wherein said proximal jaw moves generally linearly along the major axis of said handle.

7. The wrench of claim 6, wherein said proximal jaw is moved using a thumbscrew in said handle.

8. The wrench of claim 1, wherein said distal fixed jaw has a generally planar gripping surface disposed thereon, and said fixed jaw on said movable carriage has a generally planar gripping surface disposed thereon generally parallel to said distal fixed jaw gripping surface.

9. The wrench of claim 1, wherein said movable jaw on said movable carriage has a generally planar gripping surface disposed thereon, and said proximal jaw has a generally planar gripping surface disposed thereon generally parallel to said top proximal jaw gripping surface.

* * * * *